United States Patent [19]

Nist

[11] 4,191,416

[45] Mar. 4, 1980

[54] LIFT ASSEMBLY

[76] Inventor: Edward Nist, 246 Redwood Rd., Venice, Fla. 33595

[21] Appl. No.: 967,603

[22] Filed: Dec. 8, 1978

[51] Int. Cl.[2] ..... B66C 1/12

[52] U.S. Cl. ..... 294/74; 5/81 R; 254/145

[58] Field of Search ..... 294/68, 78, 74; 5/81R, 5/83, 84, 87, 88, 92; 224/49, 158, 160; 9/14; 254/145

[56] References Cited

U.S. PATENT DOCUMENTS

| | | | |
|---|---|---|---|
| 1,876,832 | 9/1932 | Bancroft | 5/89 |
| 3,363,269 | 1/1968 | Kossath | 254/145 |

*Primary Examiner*—James B. Marbert

*Attorney, Agent, or Firm*—Arthur W. Fisher, III; John Orman

[57] ABSTRACT

A lift assembly specifically designed to be used for removal of injured or incapacitated operators from an aerial, elbow type basket supported by a lifting boom of the type normally associated with the repair of power line and the like and transported by mobile type trucks. A support for the life assembly is secured either permanently or removably to the boom in spaced relation to the aerial basket so as to allow a sling to be communicated to and from the aerial basket by operation of a cable and pulley assembly. Sling is fitted about the body of the incapacitated person who is then manually removed by operation of the cable and puelley assembly, from the aerial basket to a position of safety, where life support and first aid services can be rendered as soon as possible. A housing or casing is specifically designed and configured to incompass predetermined portion of the pulley and cable assembly as well as the sling element when oriented in a stored position.

10 Claims, 2 Drawing Figures

LIFT ASSEMBLY

BACKGROUND OF THE INVENTION

1. Field of the Invention

An emergency rescue assembly designed to be used specifically for the removal of incapacitated and probably injured persons from an aerial basket of the type which is positioned in raised relation to the ground by a boom structure. The assembly may be stored in communicating relation to the aerial basket and the operators therein by direct mounting on the boom or alternately may be removed from its stored position for operative use in delivering an injured or incapacitated person to a position of safety, out of the aerial basket.

2. Description of the Prior Art

Elbow type aerial basket which are attached to a boom structure for raising the baskets and the operators therein to a predetermined height above ground are quite common in many industries. However, particularly in the power or utility industry such devices are used through there mounting on trucks or like mobile vehicles wherein the repair of power lines and other electrical facilities necessitates the extensive use of such devices. The danger of exposure to high power lines and the possibility of injury to the repairman using such aerial baskets is well acknowledged in the industry. Accordingly, every precaution is generally utilized in protecting the repairman from such injury or alternately in accomplishing immediate access to treatment of such injured repairman.

One will recognize problem associated with providing immediate emergency treatment to such repair people, when injured, is there removal from the aerial basket, in which an injury may occur, in an effective and efficient manner. Currently, common type methods utilized merely involve the handling of the man by a plurality of others and manually removing him from the basket down to the ground or a position of safety. However, many situations dictate that the availability of a plurality of persons to aid in the removal of an injured or incapacitated repair person is frequently uncommon. It is therefore, an obvious need in this particular industry for the provision of some type of assembly or facility for the removal of an injured and/or incapacitated repair person from an aerial basket in a manner that would require only a minimum amount of time being consumed as well as a minimum number of people involved to aid in the removal of the injured person.

Generally the handling of invalids or people considered to be fully or partially incapacitated in various other applications other than utility repairman has been a long recognized problem. Numeroux types of devices have been developed particularly in the area of aiding invalid patients in their entry to or removal from beds or like facilities. Frequently, such prior art devices include numerous types of suspended slings or harnesses adapted to surround different portions of the body of the invalid or patient. In addition such type of support devices have been utilized in removing partially or totally incapacitated people from vehicles or various positions of rest. Patent to Wallstrom, U.S. Pat. No. 2,523,891 is a typical structure available and present in the prior art used specifically for the design of carrying invalids or placing such invalids in a variety of positions.

In addition, U.S. patent to Cossuth, U.S. Pat. No. 3,363,269, is specifically designed to rescue incapacitated people from various environment, including wrecked vehicles, bodies of water and the like.

Such prior art devices as set forth in the above noted patents are operable for certain applications, such devices are commonly suffering from inherent problems, based on a lack of versatility or adaptability to numerous other type situations. Accordingly, such devices are generally incapable when they are attempted to be adapted for caring or moving of invalid or inacapacitated people from or to positions fro which the specific structure involved was not specifically designed.

Similarly numerous of the prior art structures which have previously been patented and/or which are commercially available frequently include the use of a pulley, cable and/or block and tackle type arrangement wherein one or more people are used to hull, lift or reposition invalid patients and/or injured persons from one location to another. However, none of these devices are adaptable or suggest specific adaptation for application in the area of aiding and/or removing incapacitated injured repair people from an aerial basket during repair, installation or general exposure to power lines or the like.

Irrespective of the type of equipment or procedure utilized in removing an injured person from an aerial basket, a prime consideration should be the offering of life support procedures as soon as possible. It is well known that brain damage can result after approximately four minutes if resucitation is not offered to a non-breathing victim. Such is frequnetly the use with shock victims. Therefore it is imperative that such victims be treated with life support techniques as soon as possible and preferable within a three minute period from time of accident. This can generally only be accomplished after the victim has been removed from the aerial basket to a position of safety where such life support procedures can be applied. Problems of this type are clearly recognized by the industry in the November 1978 issue of *Transmission and Distribution* at pages 25 through 29.

Therefore there is an obvious need in the industry for a safety device which is capable of accomplishing efficient, quick, effective and safe removal of incapacitated lineman or other injured party from the location as set forth above.

SUMMARY OF THE INVENTION

This invention relates to lift assembly specifically designed to aid in the removal of incapacitated people from an aerial basket or like position. In actual use aerial baskets are generally supported by movable boom type structure which in turn is supported on a mobile vehicle such as a truck If per chance the repair person is injured due to shock or other type of injury, it is not uncommon for such injured person to become totally incapable of aiding himself in being removed from such an aerial basket. Accordingly there is a great need in the industry for a tool or like assembly which will allow the injured and incapacitated person to be removed to a position of safety utilizing a minimum amount of outside force, help or like aid.

The subject lift assembly comprises a support means for the assembly which are generally attachable to the boom itself in spaced relation to the aerial basket. The support assembly is spaced a predetermined distance along the length of the boom so as to allow a cable and pulley to be disposed into and out of direct communication with the aerial basket itself. This pulley and cable assembly is of course manually manipulated by a single person standing either on the truck or on the ground when it is desired to use such cable and pulley assembly to aid in the removal of someone incapacitated in the aerial basket. The assembly support means itself may comprise a permanent attachment fixed to the boom which will removably support the remainder of the lift assembly thereon. Alternately an embodiment of the present invention comprises a support assembly being detachably mounted about exterior surface of the boom assembly. Such embodiment would include a flexible belt member having its ends interconnected to one another so as to be surrounded in firm engagement to the exterior of the boom.

The cable and pulley assembly comprises at least one cable and at least one pulley element which is secured directly to the support means by a common connector or the like and supported thereon with a sufficient strength as to absorb the total weight of the incapacitated person being removed from the aerial basket and lowered to a position of safety. Alternately the pulley and cable assembly can comprise other types of block and tackle assembly comprising one or more pulleys and/or cables arranged in an operable sequence to effect efficient removal of the injured party from the aerial basket through manipulation of the cables by a single person.

A sling means in the form of a harness or like structure specifically structured and configured to fit about and in surrounding relation to various portions of the body of the injured person is attached to one end of the cable. The sling means or resulting harness assembly may take various forms but must be adequately structured to sufficiently support predetermined portions of the body of the injured party so that he is not injured during his removal from the basket and lowered to a position of safety.

It should further be noted that the cable referred to above may take any type of adequate cable, rope, wire or like element which has sufficient strength when continually utilized with one or more cables to support the weight of a reasonable sized person even when such person is totaly incapacitated.

Another structural feature of the present invention comprises the provision of the casing means. This casing means must be dimensioned and structured to house the cable and pulley assembly and possibly the sling means when they are disposed in there compacted or folded, stored position. In such capacity the dimension of the casing means should be such as to completely enclose such other components of the lift assembly so as to maintain them in an out of the way location which will not interfere with the normal operation of the boom and aerial basket as well as the operator is maintaining such equipment.

When embodiment of such a casing means could comprise a pouch or bag like structure again having sufficient dimension to completely encase predetermined components of the remainder of the lift assembly. Such a pouch or bag like structure could be formed of water proof material to aid in protecting the components of the lift assembly from inclinement weather thereby extending their operable life.

The bag or pouch like structure may have an access opening for ready inspection and/or removal of the components of the lift assembly during storage and/or use or operation. Closure means may be provided in the form of hook and loop fasteners or a zipper assembly or other snap and lock type connectors which will provide fast and efficient opening of the access opening of the bag for access to the components of the assembly or the interior of the casing means.

As generally pointed out above it is also important that such entire lift assembly be adaptable to a boom structure and be able to be positioned thereon so as to effect efficient removal of a totally incapacitated person from an elbow type aerial basket supported by boom utilizing only single individual to aid in the removal of such incapacitated person.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
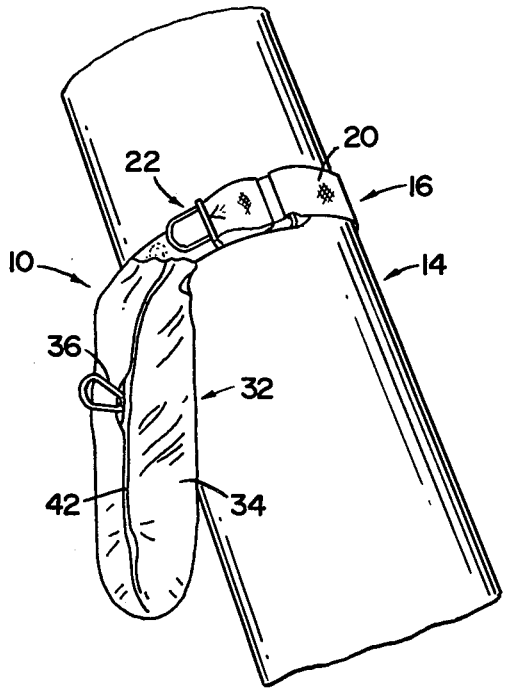
FIG. 1 is a detailed view of the lift assembly in the stored position.
Figure 2:
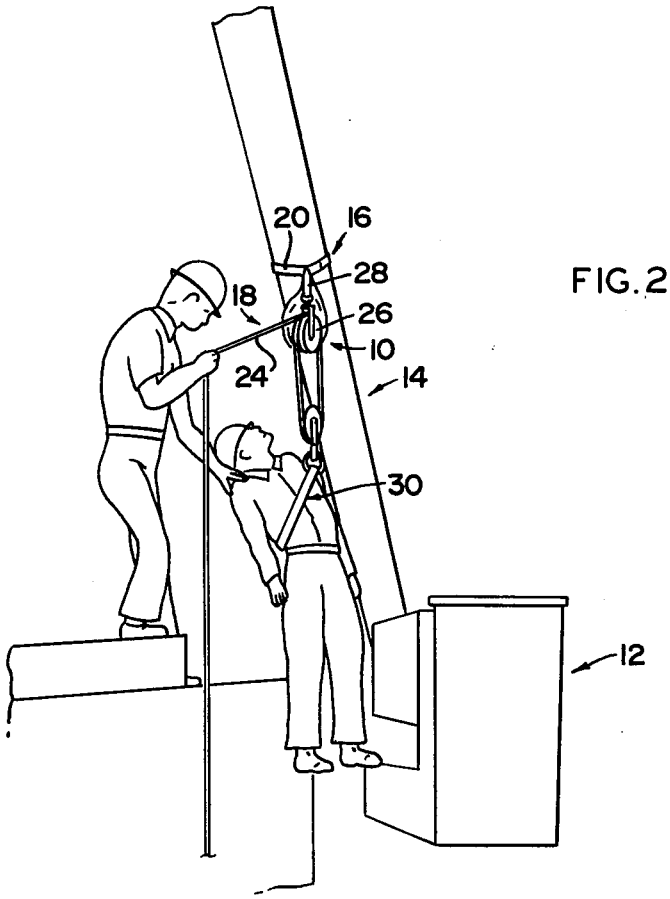
FIG. 2 is a detailed view of the lift in using.

As shown in FIGS. 1 through 3, this invention relates to lift assembly generally indicated as 10 specifically designed to aid in the removal of incapacitated people from an aerial basket 12 or like position. In use aerial baskets 12 are generally supported by movable boom type structures 14 which in turn is supported on a mobile vehicle such as a truck (not shown). If the repair person is injured due to shock or other type of injury, it is not uncommon for such injured person to become totally incapable of aiding himself in being removed from such an aerial basket 12. Accordingly there is a great need in the industry for a tool or like assembly which will allow the injured and incapacitated person to be removed to a position of safety utilizing a minimum amount of outside force help or like aid.

The subject lift assembly 10 comprises an assembly support means 16 for the lift assembly 10 which are generally attachable to the boom 14 itself in spaced relation to the aerial basket 12. The assembly support means 16 is spaced a predetermined distance along the length of the boom 14 so as to allow a cable and pulley assembly 18 to be disposed into and out of direct communication with the aerial basket 12 itself. This pulley and cable assembly 18 is of course manually manipulated by a single person standing either on a truck or on the ground when it is desired to use such cable and pulley assembly 18 to aid in the removal of someone incapacitated in the aerial basket 12. The assembly support means 16 itself may comprise a permanent attachment (FIG. 1) fixed to the boom 14 which will removably support the remainder of the lift assembly 10 thereon. Alternately an embodiment of the present invention comprises an assembly support means 16 being detachably mounted about exterior surface of the boom assembly 14. Such embodiment would include a flexible belt member 20 having its ends interconnected to one another so as to be surrounded in firm engagement to the exterior of the boom by connecting means 22.

The cable and pulley assembly 18 comprises at least one cable 24 and at least one pulley element 26 which is secured directly to the support means 16 by a common connector 28 or the like and supported thereon with a sufficient strength as to absorb the total weight of the incapacitated person being removed from the aerial basket 12 and lowered to a position of safety. Alternately the pulley and cable assembly 18 can comprise other types of block and tackle assembly comprising one or more pulleys and/or cables arranged in an operable sequence to effect efficient removal of the injured party from the aerial basket 18 through manipulation of the cables by a single person.

A sling means 30 in the form of a harness or like structure specifically structured and configured to fit about and in surrounding relation to various portions of the body of the injured person is attached to one end of the cable 24. The sling means 30 or resulting harness assembly may take various forms but must be adequately structured to sufficiently support predetermined portions of the body of the injured party so that he is not injured during his removal from the basket 12 and lowered to a position of safety.

It should further be noted that the cable 24 referred to above may take any type of adequate cable, rope, wire or like element which has sufficient strength when continually utilized with one or more cables to support the weight of a reasonable sized person even when such person is totally incapacitated.

Another structural feature of the present invention comprises the provision of the casing means 32. This casing means 32 must be dimensioned and structured to house the cable and pulley assembly 18 and possibly the sling means 30 when they are disposed in there compacted or folded, stored position. In such capacity the dimension of the casing means 32 should be such as to completely enclose such other components of the lift assembly 10 so as to maintain them in an out of the way location which will not interfere with the normal operation of the boom 14 and aerial basket 12 as well as the operator is maintaining such equipment.

When embodiment of such a casing means 32 could comprise a pouch or bag like structure 34 again having sufficient dimension to completely encase predetermined components of the remainder of the lift assembly 10. Such a pouch or bag like structure 34 could be formed of water proof material to aid in protecting the components of the lift assembly 10 from the inclinement weather thereby extending their operable life.

The bag or pouch like structure 34 may have an access opening 36 for ready insertion and/or removal of the components of the lift assembly 10 during storage and/or use or operation. Closure means 38 may be provided in the form of hook and loop fasteners or a zipper assembly 42 (FIG. 1) or other snap and lock type connectors which will provide fast and efficient opening of the access opening of the bag for access to the components of the lift assembly 10 or the interior of the casing means 32.

As generally pointed out above it is also important that such entire lift assembly 10 be adaptable to a boom structure 14 and be able to be positioned thereon so as to effect efficient removal of a totally incapacitated person from an elbow type aerial basket 12 supported by a boom utilizing only single a individual to aid in the removal of such incapacitated person.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A lift assembly of the type primarily designed for removal of an injured person from a boom supported aerial basket, said lift assembly comprising: assembly support means connected to the boom and positioned to supportingly mount said lift assembly in communicating relation to the aerial basket, a pulley and cable assembly attached to the boom, said cable movably disposed to have its length travel along said pulley into and out of direct communication with the aerial basket, sling means connected to said cable and configured for securing engagement with a person in the aerial basket, whereby and incapacitated person can be readily removed from the basket by attachment of said sling means and force being applied to said cable.

2. A lift assembly as in claim 1 wherein said assembly support means comprises a substantially rigid support elements secured to the boom along the length thereof and in spaced relation to the aerial basket, said pulley and cable assembly connected to said support element in disposable and direct communicating relation to the aerial basket.

3. A lift assembly as in claim 1 wherein said assembly support means is removably attached to the boom along the length thereof and at a predetermined distance from the aerial basket.

4. A lift assembly as in claim 3 wherein said assembly support means comprises a flexible belt means disposed in engagement and surrounding relation to an exterior surface portion of the boom, connecting means attached to opposite ends of said belt for removably interconnecting said belt to the boom.

5. A lift assembly as in claim 1 wherein said pulley and cable assembly are movably attached to said assembly support means and comprise at least one pulley and at least one cable assembly mounted thereon, casing means disposed in supported relation to said assembly support means and structured and configured for housing at least a portion of said cable and pulley assembly when in its stored position.

6. A lift assembly as in claim 5 wherein said casing means comprises a flexible pouch means including an access opening dimensioned for entry and removal of said pulley and cable assembly, closure means secured to said pouch means to allow ready opening and closing of said pouch means.

7. A lift assembly as in claim 6 wherein said closure means comprises a hook and loop type fastener allowing repeated opening and closing of said access opening.

8. A lift assembly as in claim 6 wherein said closure means comprises a zipper assembly.

9. A lift assembly as in claim 1 further comprising casing means including a pouch means and said cable and pulley assembly and said sling means disposable in folded compacted oreintation for housing and enclosing within said flexible pouch means.

10. A lift assembly as in claim 9 wherein said pouch means comprises a flexible substantially water proof material.

* * * * *